US005230517A

United States Patent [19]

Peacock

[11] Patent Number: 5,230,517

[45] Date of Patent: Jul. 27, 1993

[54] METHOD OF PLAYING A GAME FOR FOSTERING PERSONAL RELATIONSHIPS

[76] Inventor: Marlin L. Peacock, 604 Topeka St., Mansfield, La. 71052

[21] Appl. No.: 852,028

[22] Filed: Mar. 16, 1992

[51] Int. Cl.[5] ..... A63F 9/18

[52] U.S. Cl. ..... 273/432

[58] Field of Search ..... 273/293, 248, 249, 236, 273/431, 432

[56] References Cited

U.S. PATENT DOCUMENTS

| | | | |
|---|---|---|---|
| 4,682,956 | 7/1987 | Krane | 273/243 |
| 4,854,594 | 8/1989 | Eaton | 273/249 |
| 4,872,681 | 10/1989 | Martin | 273/236 |
| 4,966,371 | 10/1990 | Sherman | 273/243 |
| 5,054,775 | 10/1991 | Banks | 273/431 |

FOREIGN PATENT DOCUMENTS

| | | | |
|---|---|---|---|
| 1263126 | 11/1989 | Canada | 273/249 |

OTHER PUBLICATIONS

Games Magazine, "Dr. Ruth's Game of Good Sex", Feb. 1986, p. 50.

*Primary Examiner*—Benjamin H. Layno
*Attorney, Agent, or Firm*—Rod Bryant Jordan

[57] ABSTRACT

A game designed to aid in fostering personal relationships using a board, a pair of dice, several stacks of question and command cards, a timer, a box of laxatives, and several other related objects. The purpose of the game is to force the fostering of personal knowledge between couples through the forced answering of random questions dealing with personal relationships upon certain random occurrences.

1 Claim, 1 Drawing Sheet

METHOD OF PLAYING A GAME FOR FOSTERING PERSONAL RELATIONSHIPS

BACKGROUND OF THE INVENTION

The invention herein disclosed relates generally to a board game and more specifically to a game using a board, a pair of dice, several stacks of question and command cards, a timer, a box of laxatives, and several other related objects. The game herein described, which will be called "Quiz-N-Match" or some other appropriate name, is so designed to provide amusement while addressing a serious problem. It is the purpose of this game to allow strangers of the opposite sex to get to know one another through the answering of random questions asked according to random events, thereby presenting the elements of chance, excitement, and amusement to the acquaintance process.

DESCRIPTION OF THE PRIOR ART

There have been many board games designed for the purpose of allowing participants to get better acquainted, however, these games have traditionally lacked the proper combination of fun, candor, and sincerity that is necessary in today's vastly more complex society. The society in which we live today, replete with a host of pitfalls such as divorce, date rape, and AIDS gives rise to a need for a game that will entertain yet inform the participants of the true feelings and personality traits of those who would wish to associate closely with one another. The invention as herein described provides such a mechanism.

SUMMARY OF THE INVENTION

The invention herein described comprises a game utilizing a board, a pair of dice, six stacks of question cards, one stack of command cards, score pads, pencils, name tags, and various articles such as a box of laxatives related to the command cards. The game is designed to be played by up to ten males and ten females. There are seperate stacks of question cards for the male and female players. Each player is given a chance to ask two questions of a player of the opposite sex during each of his or her turns. The question cards are divided into six stacks, three pink stacks for the females and three blue stacks for the males. One pink and one blue stack contains questions relating to communication. One pink and one blue stack contains questions relating to sex, and one pink and one blue stack contains questions relating to commitment. An example of a communication question would be "Your date wants to see a movie that you have no desire to see. How do you handle it?". An example of a sex related question would be "You are interested in someone, but are concerned about AIDS. How do you talk to them about it?". An example of a commitment question would be "You are out of town on a trip and run into an old friend. He or she suggest that you should get together. You are in a steady relationship. How do you handle it?".

The seventh stack of cards contain commands. This stack is referred to as the "Chicken Pile". Upon certain occurrences that are bound to happen during the playing of the game players will be instructed to draw from the "Chicken Pile" and to follow the command that is drawn. These commands will instruct the player to do something awkward or embarrassing as punishment for not playing properly or just having bad luck. An example of a Chicken Pile command would be, "Take a laxative and continue playing".

To start the game, each female rolls the dice to get the order of play. The female that rolls the highest number goes first. The males also roll the dice in order to get the order of play. The male who rolls the highest number takes his turn directly after the first female to play. Each player's turn is then determined by the number that is cast. Each female player writes her name and order of play from 2 through 11 on a pink name tag to be placed on her chest. Each male player writes his name and order of play from 2 through 11 on a blue name tag to be placed upon his chest. If the game is to be played by five players or less the identification numbers will range from 1 to 5, and only one die will be used.

To play the game the female with the highest number goes first. The female player rolls the dice. The male player with the number rolled is asked a question from the blue stack of cards. The male chooses which pile the question comes from, the communication stack, the sex stack, or the commitment stack. The female player picks up the top card of the stack that the male player has chosen and reads it to the male player. The male player has a specific amount of time in which to answer the question that he chose. A digital timer situated in the center of the board is activated as soon as the question is asked. This timer signals when the allotted amount of time has expired. After the male answers the question, the female chooses a stack and reads a question to the male. Again the male player has a specific amount of time in which to answer the question. The female's turn is then over and the turn goes to the male with the highest role of the dice. The male player rolls the dice in order to determine to whom he will be asking the question. The female with the number that is rolled is asked a question from the stack of cards of her choice. The male reads the question to the female and she has a specific amount of time in which to answer the question. The male player then chooses a stack from which to ask a question. Again, the female player has a specific amount of time in which to answer this question. At this point the dice is given to the female player next in turn. This process is followed until everyone has had a turn.

The first time a player rolls a twelve "box cars" (a six when playing with five players or less) that player is allowed to pose a question to any player of the opposite sex that they choose. After each turn the player scores the person that they have questioned on a scale from one to ten and records the score on the score pad.

Upon certain occurrences players are forced to draw commands from the dreaded "Chicken Pile". If a player rolls the number of an opposite sex player in succession the player rolling the dice must draw from the "Chicken Pile". If a player rolls a twelve "box cars" a second time, (a six when playing with five players or less) and for each successive time thereafter, that player must draw from the "Chicken Pile". If a player refuses to answer a question or fails to complete his answer within the allotted time that player, having failing to answer, must draw from the "Chicken Pile".

It is submitted that the playing of this game will provide an amusing method of allowing strangers to get to know one another in a short period of time.

BRIEF DESCRIPTION OF THE DRAWINGS

Figure one is a perspective view of the board equipped with game playing articles.

Figure two is a view of the game score card.

Figure 1:
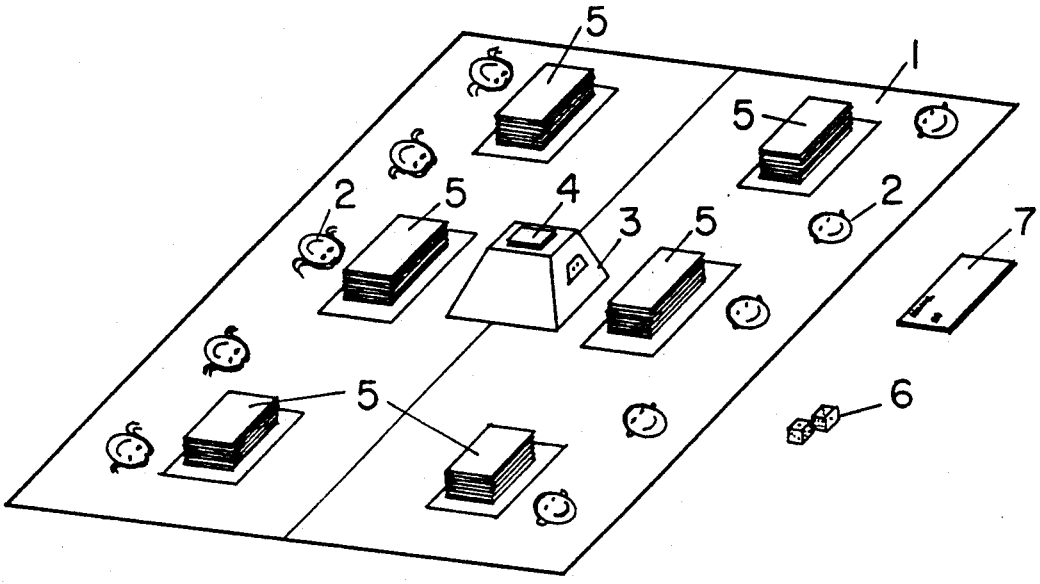
Figure 2:
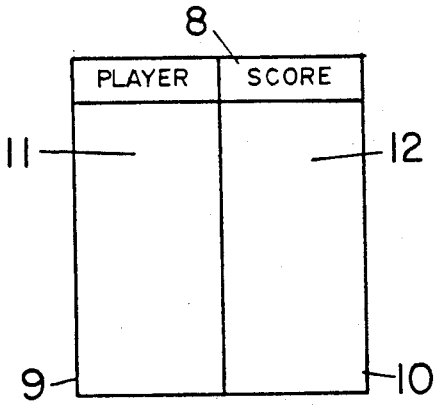
Figure 3:
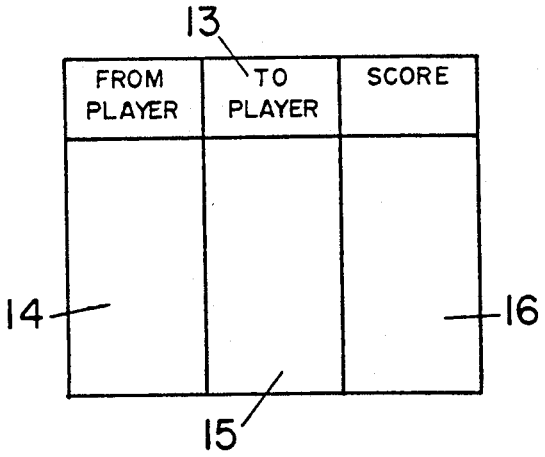

Figure three is a view of the final score card that is given to each player.

DETAILED DESCRIPTION

Referring to the drawings, and more specifically to figure one, it can be seen that a game board 1 is labeled with male and female faces 2. These likenesses indicate the side of the board at which the two sexes of players will be situated. A two sided digital timer 3 is situated in the center of the game board 1. A stack of command cards "Chicken Pile" 4 is positioned atop the digital timer 3. For design and amusement purposes a strange looking chicken is depicted on the back of each command card. Three stacks of question cards 5 are positioned on either side of the timer 3 so that players may comfortable draw from any of the three stacks. A pair of dice 6 is made available for casting and name tags 7 are also provided.

Referring to figure two it can be seen that a game score card 8 is provided with a section indicating the player being scored 9 by placing the number appearing on that player's name tag 7 within the section 9 provided, and a section indicating the score 10 being given to each player. Numerals 11, appearing in section 9 indicate the player being scored and numerals 12, appearing in section 10 indicate the score being given to each player.

Referring to figure three it can be seen that a final score card 13 is provided. A section 14 is provided for indicating which player is doing the scoring. A section 15 is provided for indication the player that is being scored and a section 16 is provided for the score that is given. The game score card 8 and the final score card 13 are provided, in tablet form, to be used and disposed of.

In order to play the game the female players situate themselves along side the game board 1 adjacent to the side displaying the female faces 2 and the male players situate themselves along side the game board 1 adjacent to the side displaying the male faces 2. Each player then rolls the dice 6 in order to ascertain the order of play. The female who rolls the highest number goes first, then the male with the highest number, and so on. Each player now writes their order of play along with their name on the name tag 7 to be placed upon their chest for identification and scoring.

To play the game the female with the highest number (first order of play) rolls the dice 6. The male player whose number matches that rolled by the female player chooses one of the blue stacks of question cards 5 from which the female asks a question. After the question has been answered the female chooses one of the blue question stacks 5 from which to ask a question. Upon the asking of a question a digital timer 3, which is situated in the center of the game board 1, is activated. This gives the person answering a specific amount of time in which to answer the question. If they fail to answer within the time allotted, or if they refuse to answer, they must chose a card from the command card stack 4 which is located atop the digital timer 3. They must obey whatever the command card demands of them. The female player's turn is now over and the male with the highest order of play has an identical turn. Each time a question is posed the player posing the question scores the person answering the question on a scale from 1 to 10 and records the score on the game score card 8. This process is repeated until each player has posed a question to at least one half of the opposite sex players.

If a player rolling the dice 6 rolls a double six, (or a single six when playing with five players or less) they may pose a question to anyone that they choose. If a player rolls another double six in succession, and for each double six rolled in succession, that player must draw a command card from the command card stack 4, and follow the command. If a player rolls the number of any player twice in succession the player rolling the dice 6 must draw a command card from the command card stack 4 and follow the command.

When the game has been completed each player records a mean average of the randomly received scores of each of the opposite sex players in section 16 of the final score card 13. These scores indicate how opposite sex players were rated by the player according to how they felt about the answers that they received from each opposite sexed player. These average scores correspond to the names in section 15 of the final score card 13. The final score cards 13 are then shown to the opposite sexed players, to be analyzed by the group in determining which players would be best suited as couples. After these determinations have been made the game is over.

The preceding detailed description is not intended to limit the use of this game to a specific format. It is intended to give a general outline of the process of playing a game which employs the principles as lain out above.

I claim:

1. A method of playing a game relating to and to be used for fostering personal relationships to be played by a plurality of female and male sexed players comprising the steps of;

a. providing a game board, a pair of dice, a stack of male oriented commitment related question cards, sex related question cards, and communication related question cards, a stack of female oriented commitment related question cards, sex related question cards, and communication related question cards, a stack of command cards each having instructional commands, a timer, a game score card, a final score card, and a plurality of name tags.

b. rolling said pair of dice in order to ascertain an order of play, c. rotating said order of play from said female to said male sexed players in accordance with the magnitude of the number on said pair of dice that each said player rolled, d. fastening a name tag to the chest of each said player, and writing the order of play on said name tag, e. first said player rolling said dice, f. said player, opposite in sex to first said player, and whose number as recorded on said name tag corresponds to the number rolled choosing one of said stacks of question cards oriented to that player's sex, said player that rolled first said dice choosing a question card from said chosen stack of question cards, first said player that rolled said dice posing said question to said player whose number corresponds to said number rolled, said player whose number corresponds to the number rolled answering said question within a specific period of time as measured by said timer, said player being forced to draw from said stack of command cards upon failing to answer said question within said specific period of time, said player being forced to follow said command, first said player that rolled said dice then choosing one of said stacks of question cards oriented to said player's sex whose number corresponds to the number rolled, first said player that rolled said dice drawing one of said cards from said chosen stack, and posing said question to said player whose number corresponds to said number rolled, said player being compelled to answer said question within said specific period of time or being forced to draw from said stack of command cards, and being forced to follow its instructional command, first said player that rolled said dice assigning a score to said players answer, first said player that rolled said dice recording said score on said game score card, g. each of said players repeating steps e) and f) according to said order of play until all of said players have posed a plurality of questions to a certain percentage of the other said players of said opposite sex, h. said players being forced to draw from said command pile upon certain occurrences, said occurrences comprising rolling the number twelve in succession, and rolling said name tag number of one of said opposite sexed players in succession, i. each of said players rating said scores of each of said opposite sexed players questioned, said players recording said scores upon said final score card; and j. each of said players sharing said scores with said players of their choice.

* * * * *